United States Patent [19]

Bako

[11] 4,281,525

[45] Aug. 4, 1981

[54] HARDWARE FOR LUGGAGE AND THE LIKE

[75] Inventor: Lazlo Bako, Woodcliff Lake, N.J.

[73] Assignee: Presto Lock Company, Division of Walter Kidde & Co., Inc., Garfield, N.J.

[21] Appl. No.: 949,992

[22] Filed: Oct. 10, 1978

[51] Int. Cl.[3] ..... E05B 65/52

[52] U.S. Cl. ..... 70/71; 70/312

[58] Field of Search ..... 70/66, 69, 70, 71, 72, 70/73, 74, 75, 76, 312; 16/110 R, DIG. 24; 190/55 A, 56, 57

[56] References Cited

U.S. PATENT DOCUMENTS

| | | | |
|---|---|---|---|
| 3,800,571 | 4/1974 | Heine | 70/71 |
| 3,961,505 | 6/1976 | Gehrie | 70/66 |

*Primary Examiner*—Robert L. Wolfe

*Attorney, Agent, or Firm*—Shapiro and Shapiro

[57] ABSTRACT

Improved hardware for luggage comprises handle studs mounted on a valance member and pivotally supporting latches that are spring-biased to an open position and that are held closed by spring-biased control rods. Manual actuators move the control rods in a direction to release the latches, and a combination lock mounted in one handle stud blocks or permits such movement. In a modification, a single latch and manual actuator are employed with a combination lock disassociated from the luggage handle.

22 Claims, 11 Drawing Figures

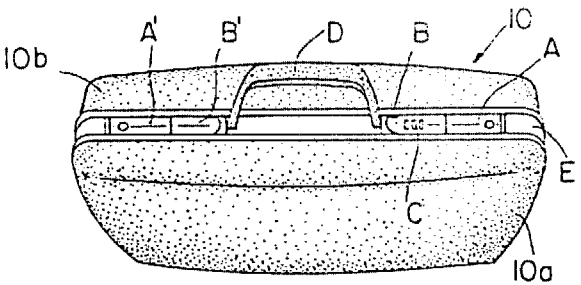
FIG. 1
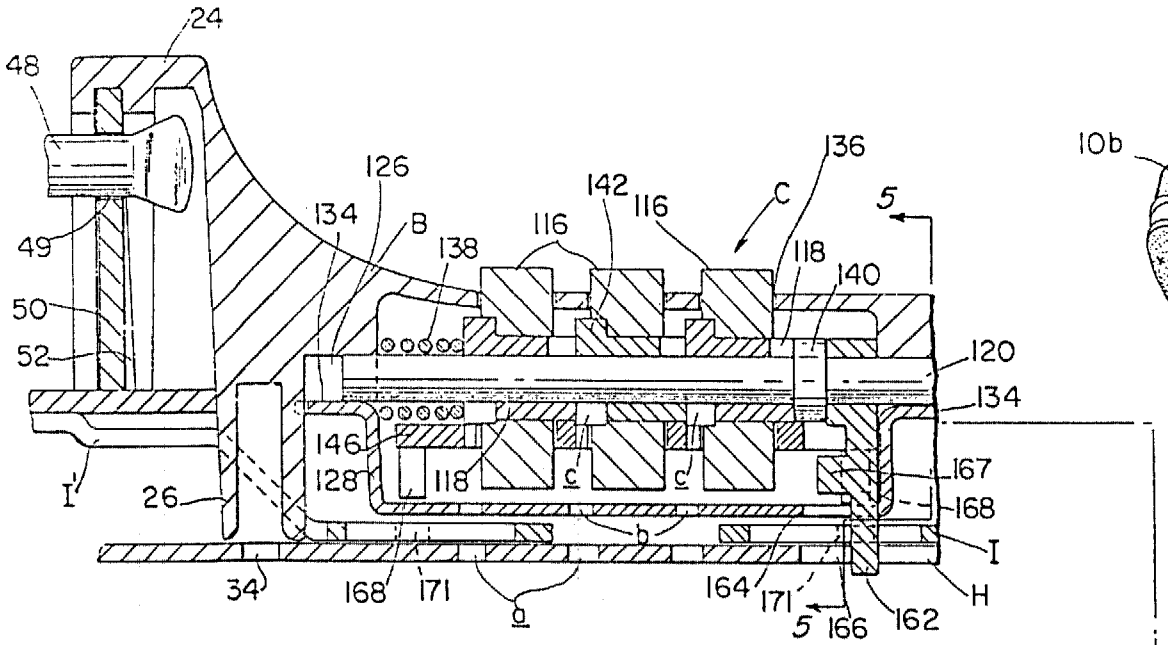
FIG. 3
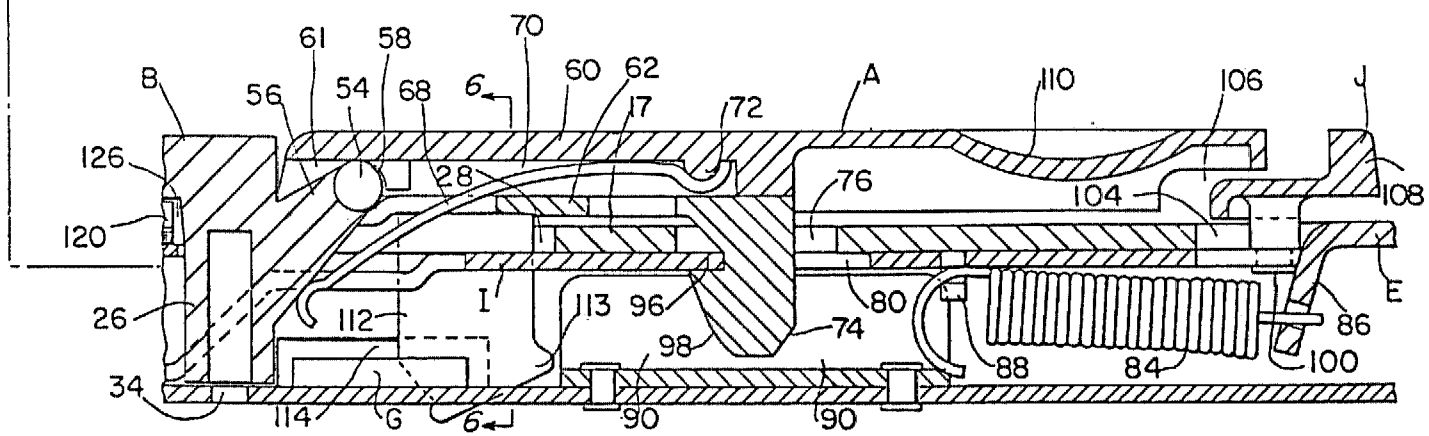

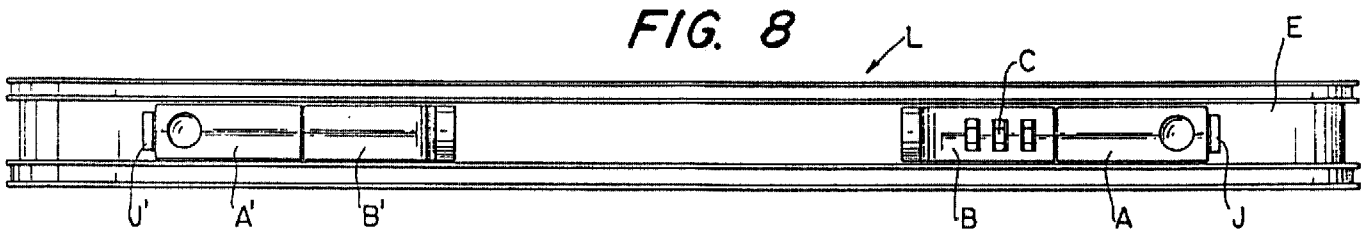
FIG. 8
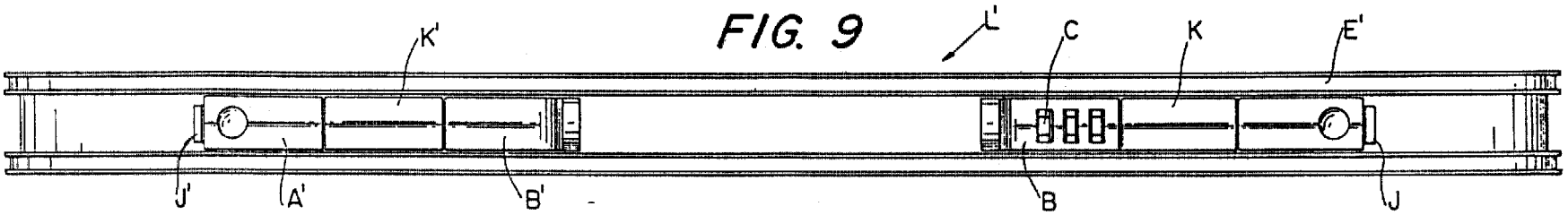
FIG. 9
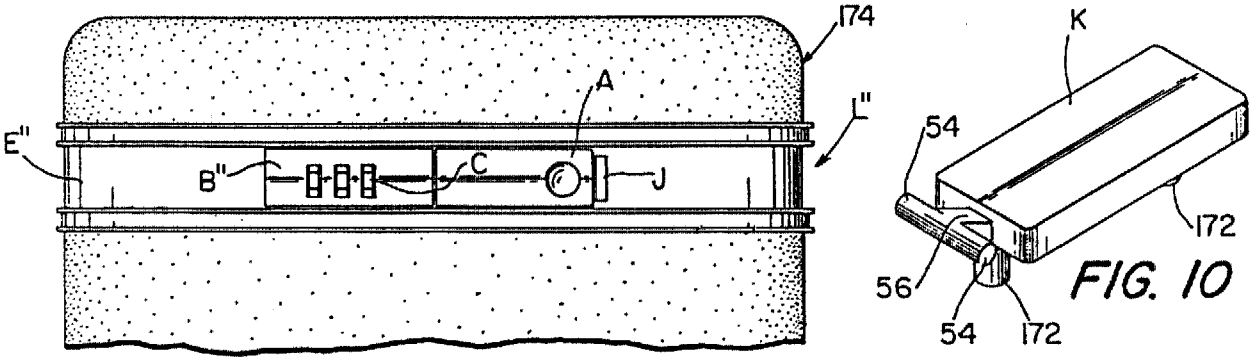
FIG. 10
FIG. 11

HARDWARE FOR LUGGAGE AND THE LIKE

BACKGROUND OF THE INVENTION

This invention relates to hardware for luggage and the like and is more particularly concerned with luggage hardware employing a combination lock to control the release of one or two pivoting latches.

U.S. Pat. No. 3,961,505, issued June 8, 1976, and assigned to the same assignee as the present invention, discloses hardware for luggage and the like in which a single combination lock is effective to control the release of a pair of pivoting latches. In the patented hardware, turning of a single manual actuator advantageously opens both pivoting latches if the lock is "on combination" and release a pair of hasps. However, the mechanism that controls the latches and the hasps depends upon butt type relationships and has certain complexities and close tolerances that increase the expense of the luggage hardware.

U.S. Pat. No. 3,555,860, issued Jan. 19, 1971, also discloses luggage hardware in which a single combination lock controls a pair of latches, but the latches are of a sliding type. Such latches lack the advantage of spring-biased pivoting latches, that facilitate the opening and closing of luggage.

U.S. Pat. No. 3,543,545, issued Dec. 1, 1970, U.S. Pat. No. 3,800,571, issued Apr. 2, 1974, and U.S. Pat. No. 3,952,561, issued Apr. 27, 1976, all assigned to the same assignee as the present invention, disclose luggage hardware in which a combination lock directly controls the release of an associated hasp. The hardware of these patents does not have the advantages of spring-biased pivoting latches or of multiple latches controlled by a single combination lock.

BRIEF DESCRIPTION OF THE INVENTION

It is accordingly a principal object of the invention to provide improved hardware for luggage and the like—hardware that has the advantages of pivoting latches controlled by a combination lock, but that is simpler, less expensive, and more versatile than comparable hardware of the prior art.

Another object of the invention is to provide an improved console for luggage, including improved luggage hardware components.

A further object of the invention is to provide improved latches, improved latch mountings, improved handle mountings, and an improved combination lock.

Briefly stated, in accordance with one aspect of the invention, hardware for luggage cases and the like comprises a valance member adapted to be attached to one part of a luggage case along an edge thereof, a latch, means supporting the latch on the valance member for pivotal movement about an axis perpendicular to the edge near one end of the latch, the latch being pivotally movable away from the valance member to an open position and toward the valance member to a closed position, spring means for biasing the latch toward its open position, control means supported for movement along the valance member, the control means and the latch having cooperating catch elements that are engageable to hold the latch in its closed position, spring means for biasing the control means in a first direction to engage the catch elements, and manual actuator means near the opposite end of the latch and coupled to the control means for moving the control means in a second direction to disengage the catch elements and release the latch for movement to its open position, the latch having a latch element thereon adapted to engage a cooperable latch element on a second part of the case that moves toward the valance member when the parts of the case are brought together.

In accordance with another aspect of the invention, a combination lock comprises a housing having a face plate with slots therein, a shaft having combination dials supported for rotation thereon, the plate having support surfaces at its interior side against which the ends of the shaft are supported, with the dials protruding through the slots, respectively, by an amount determined by the engagement of the ends of the shaft with the support surfaces.

In accordance with another aspect of the invention, a latch mechanism for luggage comprises a mounting plate adapted to be mounted on a base, a latch plate, the mounting plate having a T-bar projecting from one end thereof and providing trunnions received in recesses beneath one end of the latch plate for pivotally supporting the latch plate on the mounting plate for movement between open and closed positions, the latch plate having a catch element thereon adapted to engage a cooperable catch element when the latch plate is moved to its closed position, and an ejector spring mounted between said plates and urging the latch plate to its open position.

In accordance with a further aspect of the invention, a handle mounting assembly for luggage or the like comprises a base, a pair of handle studs, each having an open end with an internal groove, fastener means for attaching the handle studs to the base with the open ends in spaced opposition, and a handle dimensioned to fit between the studs and having washers at opposite ends adapted to enter the corresponding open ends of the studs and to be retained in the grooves, the shapes of the washers and the grooves being correlated so that the washers can enter the open ends laterally when the studs are separated from the base and be trapped in the grooves when the studs are thereafter tightly fastened to the base.

BRIEF DESCRIPTION OF THE DRAWINGS

The invention will be further described in conjunction with the accompanying drawings, which illustrate preferred and exemplary embodiments, and wherein:

FIG. 1 is a perspective view illustrating luggage incorporating hardware in accordance with the invention;

FIG. 3 is a fragmentary longitudinal sectional view illustrating a combination lock, a pivoting latch, and associated parts employed in the invention;

FIGS. 8 and 9 are plan views illustrating hardware of the invention for luggage of different lengths;

FIG. 10 is a perspective view of a spacer plate employed in the hardware of FIG. 9; and FIG. 11 is a truncated elevation view of another type of luggage employing hardware in accordance with the invention.

DETAILED DESCRIPTION OF PREFERRED EMBODIMENTS OF THE INVENTION

Hardware employed on suitcases or similar luggage commonly includes one or two latches in association with one or two locks. Mating valance members may be attached to the peripheries of corresponding hinged parts of the luggage, one valance member supporting the locks and the latches and the other valance member supporting hasps that are releasably retained by the latches. The invention will be described in its preferred application to luggage hardware of this type, but the following description is merely illustrative of the utility of the invention.

As shown in FIG. 1, a suitcase or other carrying case 10 may have hardware including latches A, A' and handle studs B, B', one of which houses a combination lock C. A handle D is attached to studs B, B', as described later. A valance member E attached to an edge of hinged part 10*a* of case 10 may provide a base for the hardware employed in the invention. A cooperable valance member (not shown in FIG. 1) is attached to an edge of hinged part 10*b* of case 10 and support hasps (not shown in FIG. 1) which are releasably retained by latches A and A'. The cooperable valance member F and hasps G, G', which may be conventional, are indicated in phantom lines in FIG. 2.

Figure 2:
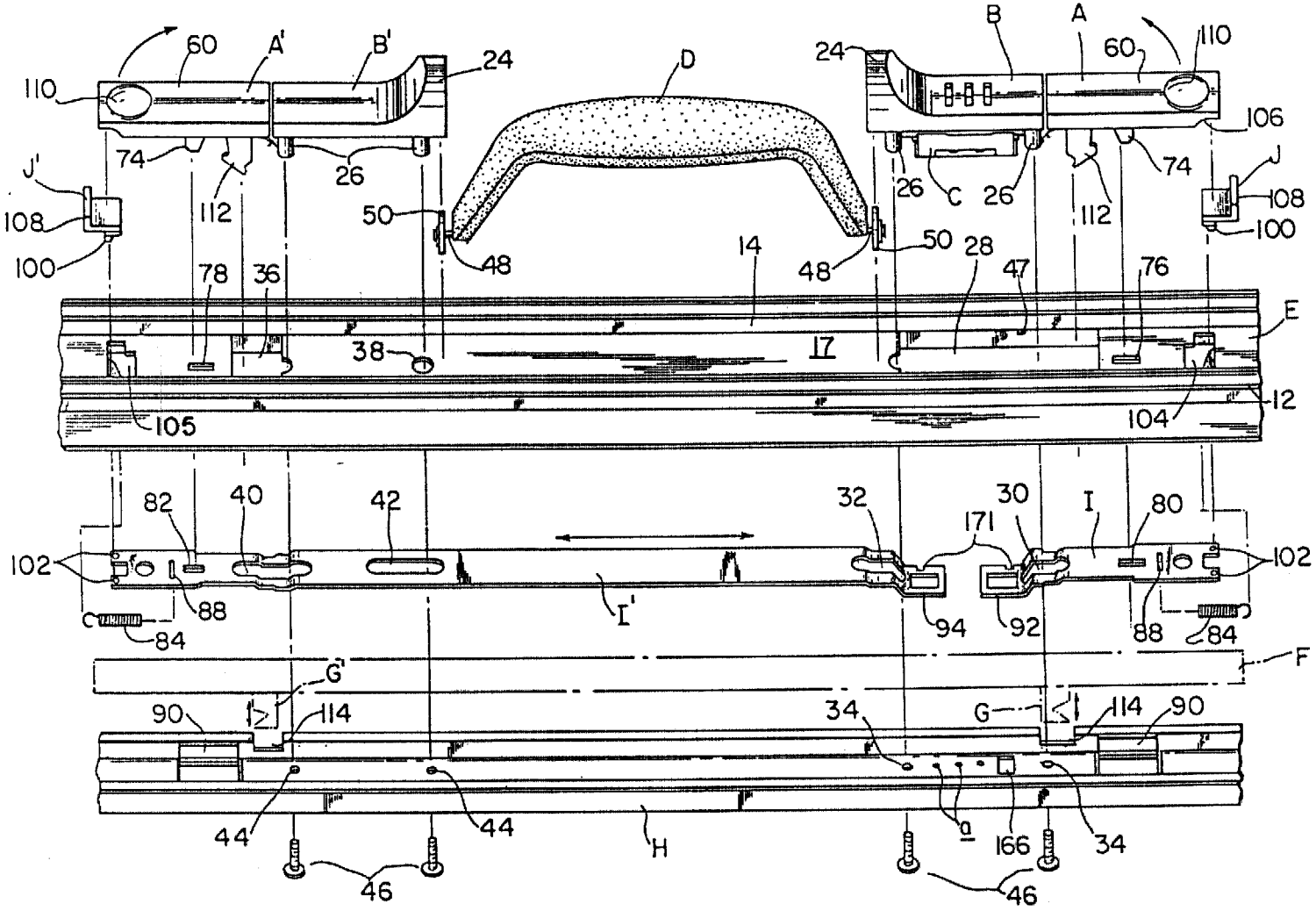
FIG. 2 is an exploded perspective view illustrating hardware in accordance with the invention.
Figure 5:
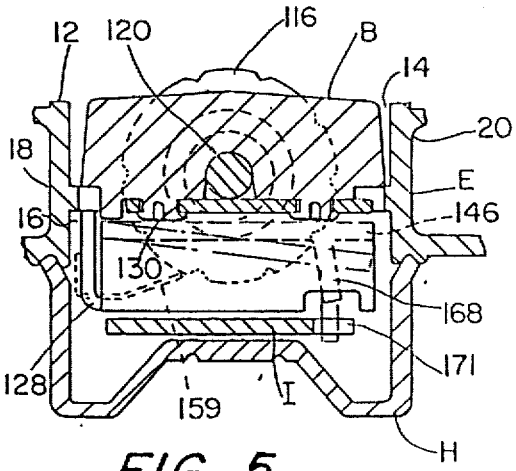
FIGS. 5 and 6 are sectional views taken along lines 5—5 and 6—6 of FIG. 3, respectively.
Figure 6:
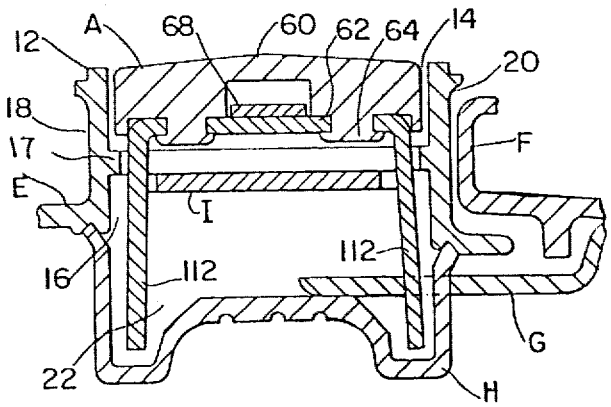

As shown in FIGS. 2, 5 and 6, the valance member E, which may be attached to the carrying case along a longitudinal edge 12 in a conventional manner, is shaped to provide channels 14 and 16 at opposite sides of a web 17. Channel 14 faces outwardly of the luggage and channel 16 inwardly. Further channels 18 and 20 are preferably provided along the longitudinal edges of valance member E, channel 18 receiving the raw edge of part of the carrying case and channel 20 receiving the cooperable valance member F, which supports the hasps G, G'. As shown in FIG. 2, an inner channel piece H mates with valance member E along that portion of the valance member that supports the latches A, A', the handle studs B, B', the lock C, and the handle D and forms with valance member E an elongated shell 22 which encloses control rods I, I' (see FIGS. 3, 5 and 6). In the form shown, the control rods are plate-like, but the term "rods" is intended to embrace structures of different cross-sectional configuration. As will become apparent hereinafter, the control rods I, I' are supported for reciprocation in the shell 22.

The handle studs B, B' are preferably hollow and may have a generally rectangular configuration with an upraised portion 24. Each stud may have mounting posts 26. The mounting posts 26 of stud B pass through opening 28 in valance member E and through openings 30 and 32 in control rods I and I' and are aligned with openings 34 in channel piece H. The mounting posts 26 of stud B' pass through openings 36 and 38 in valance member E and through openings 40 and 42 in control rod I' and are aligned with openings 44 in channel piece H. Posts 26 may abut the bottom of channel piece H and be internally threaded to receive screws 46 or may have integral rivets that are expanded at the underside of channel piece H. In either case, the lower edges of handle studs B, B' may rest on the bottom of channel 14 and on appropriate abutments such as 47. Attachment of the handle studs to channel piece H is also effective to join the channel piece H to valance member E, although additional fasteners may be used.

Figure 4:
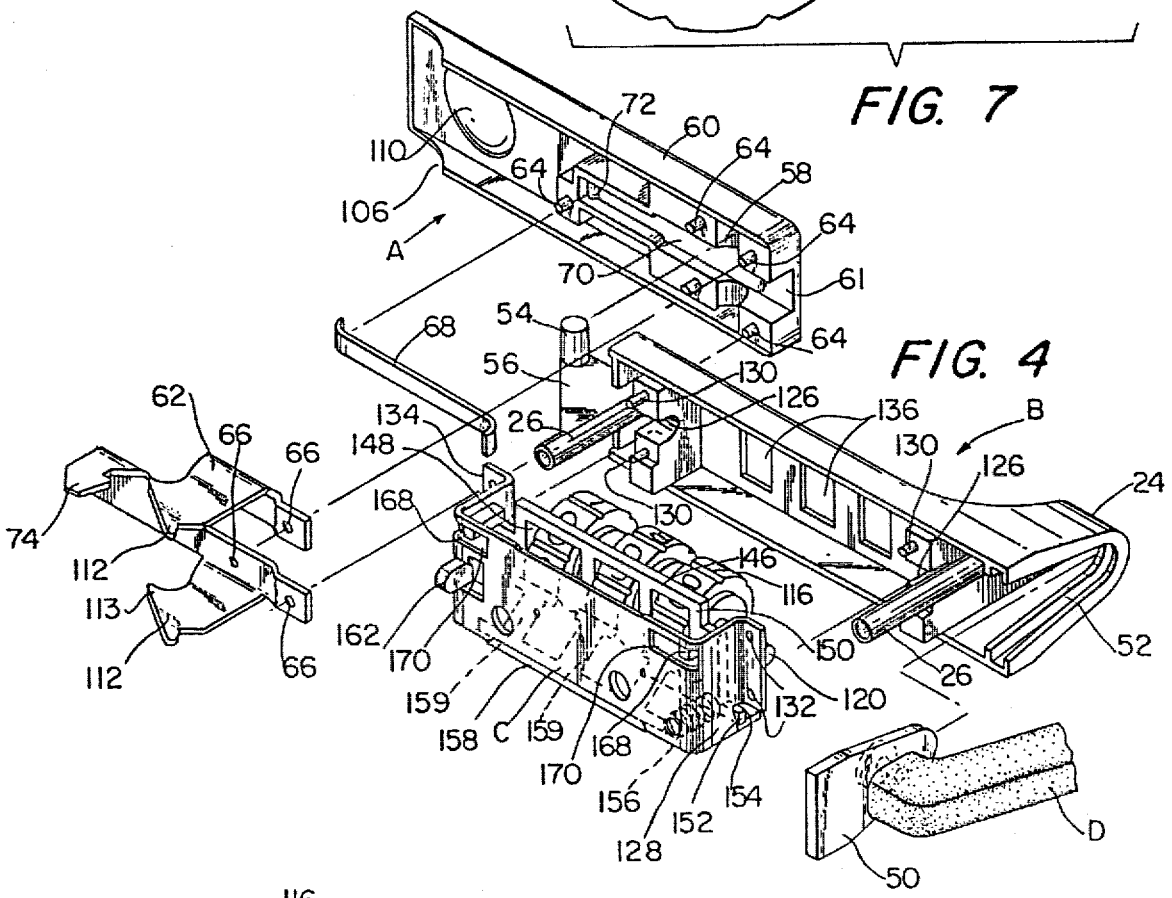
FIG. 4 is an exploded perspective view illustrating a combination lock, a pivoting latch, a handle stud, and a handle end employed in accordance with the invention.

As shown in FIGS. 2–4, handle D has wires 48 protruding from its ends and extending through holes 49 near the top of mounting washers 50. The ends of the wires are flattened so that the mounting washers cannot be removed. The handle is dimensioned to fit between the opposed upraised portions 24 of the handle studs B, B'. The mounting washers are received in internal grooves 52 (see FIG. 4) extending about open ends of the upraised portions 24, the open ends being tapered so that they are widest at the valance member E. The mounting washers 50 are also preferably tapered as shown. The correlation of the shapes of the mounting washers and grooves 52 permits the mounting washers to be inserted laterally into the open ends of the upraised portions 24 when the handle studs B, B' are slightly separated from the valance member E and then to be trapped in grooves 52 when the studs B, B' are tightly secured to the valance member E, thereby securing handle D to the valance member E.

In the form of the invention illustrated in FIGS. 2–4, latches A and A' are pivotally supported on studs B, B', respectively, which form latch mounting plates. As shown in FIGS. 3 and 4, the end of each of the studs opposite the upraised portion 24 has integral trunnions 54 at opposite sides of a central support element 56 (see FIG. 10 also), forming a T-bar. Trunnions 54 are received in arcuate bearing grooves 58 at one end of a plate 60 forming part of each latch. A notch 61 in plate 60 provides clearance for the support element 56. When a hook member 62, also forming part of each latch, is assembled with the associated latch plate 60, trunnions 54 are trapped in the bearing grooves 58, providing a concealed pivot. Plate 60 may be formed with integral rivets 64 which pass through corresponding holes 66 in the hook member 62 and are expanded to mount the hook member on the latch plate.

Each latch mechanism includes as a part thereof a latch ejector spring 68. The ejector spring may be a leaf spring having the configuration shown and may be trapped within a central groove 70 of the latch plate 60 when the hook member 62 is assembled with the latch plate. One end of spring 68 engages boss 72 on the latch plate, and the other end abuts the trunnion support element 56, as shown in FIG. 3. By this arrangement, latches A, A' are supported on valance member E, via the handle studs B, B', for pivotal movement about axes that are perpendicular to the edge of a luggage case on which valance member E is mounted and are resiliently biased away from the valance member to an "open" position.

Each hook member 62 has a central catch element or hook 74. These catch elements pass freely through slots 76, 78 in valance member E and enter slots 80, 82 in control rods I, I'. The control rods are biased away from each other by tension spring 84. One end of each spring engages a lug 86 downwardly turned from valance member E, and the other end of each spring engages a lug 88 depending from the associated control rod I or I' (see FIG. 3). In the form shown, the control rods are supported for reciprocation along the valance member E by U-shaped brackets 90 secured to channel piece H, as by rivets, and having upwardly projecting arms that support the underside of the corresponding control rods. Adjacent ends 92 and 94 of the control rods are bent so as to engage the bottom of channel piece H for additional guidance and support of the control rods.

When the control rods, I, I' are moved away from each other by springs 84, catch elements 96 (FIG. 3) constituted by portions of the control rods adjacent to slots 80 and 82 are positioned for engagement with cooperating catch elements 74 of the latches A, A'. Catch elements 74 have tapered noses 98, which engage the associated catch elements 96 of the control rods as the catch elements 74 enter slots 80 and 82. This creates a camming action which moves the control rods toward each other, stressing the associated springs 84. When catch elements 74 have entered slots 80 and 82, the springs snap the control rods away from each other, engaging catch elements 74 with catch elements 96, so as to hold the latches in a "closed" position.

To move the control rods I, I' toward each other in order to release the latches, the control rods are provided with manual actuators J, J' adjacent to the ends of latch plates 60 that are remote from trunnions 54. The actuators may be generally L-shaped and may be coupled to the control rods by integral rivets 100 which depend from the actuators, enter corresponding holes 102 at one end of the control rods, and are expanded to affix the actuators to the control rods. The depending portions of actuators J, J' pass through corresponding slots 104, 105 in valance member E with sufficient freedom so that the actuators J, J' may move toward and away from each other, producing corresponding movement of the control rods I, I'. Opposite edge portions of each actuator preferably slide on corresponding surfaces at the bottom of channel 14 of valance member E. As shown in FIGS. 2–4, one end of each latch plate 60 is preferably recessed, as at 106, so that the associated actuator J or J' may fit under the latch plate. Each actuator may have an upraised finger tab 108 that is spaced from the adjacent end of the latch plate 60 to provide adequate range of movement of each actuator J, J' toward the other. Movement of the actuators away from each other may be limited by engagement of the actuators with lugs 86, for example, as shown in FIG. 3, or by engagement of the control rods I, I' with mounting posts or other elements that pass through the control rods.

As is apparent in FIG. 3, when a manual actuator such as actuator J, for example, is pushed in a direction toward the other actuator, corresponding catch elements 74 and 96 will be disengaged, releasing the associated latch, which is popped open by its ejector spring 68. Pressure may be exerted on each latch plate 60, as at finger depressions 110, to close the latches again.

As shown in FIG. 4, each hook member 62 has at least one additional hook element or latch element 112. In the form shown, two such latch elements 112 are provided adjacent to opposite sides of the shell 22 (see FIG. 6). This provides right-handed or left-handed capability without specialized parts. Only one of the latch elements 112 of each hook member 62 actually is used, however. As shown in FIG. 6, the latch element 112 in use (the right one in FIG. 6) engages a corresponding hasp G (or G'). As is apparent in FIG. 2, hasps G, G' enter slots 114 in channel piece H. This may only occur when the latches A, A' are open, because when the latches are closed, the slots are blocked by latch elements 112. When the latches are closed after insertion of the hasps G, G' in slots 114, latch elements 112 enter conventional notches in the associated hasps G, G' to retain the hasps. By appropriately tapering the latch elements 112 and the corresponding latch elements (notches) of the hasps, in a well known manner, a camming action can be produced to draw the hasps into the channel piece H as the latches are closed. Proturberances 113 on latch elements 112 may engage the web 17 of valance member E to limit the outward pivotal movement of the latches.

From the foregoing description, it is apparent how the latches A, A' are closed and held closed to retain the hasps G, G', and how the latches are opened to release the hasps. It is now in order to describe the combination lock C and how the combination lock controls the latches to determine when the latches can be opened.

In the preferred embodiment, the combination lock is of the general type disclosed in U.S. Pat. No. 3,800,571, referred to earlier and incorporated herein by reference. However, the combination lock disclosed herein has certain improvements which will be described. In the form of the invention illustrated in FIGS. 2–4, combination lock C is mounted upon and housed in one of the handle studs, stud B, for example.

Figure 7:
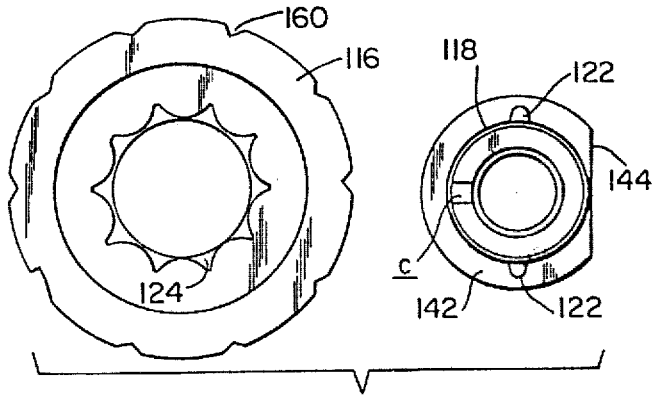
FIG. 7 is a side elevation view of parts of a combination lock which may be employed in the invention.

The combination lock comprises a plurality of number dials 116 and corresponding sleeves 118 (see FIG. 7). As shown in FIG. 3, the sleeves 118 are supported on a shaft 120, each dial 116 being mounted on an associated sleeve. The sleeves have external teeth 122 which engage internal serrations or teeth 124 of the dials, so that each dial is normally coupled to its sleeve for rotation therewith. The ends of shaft 120 fit within arcuate recesses 126 (FIG. 4), which may be formed integrally with stud B, and are trapped in the recesses when a frame 128 of the lock is assembled with the stud. The stud may be formed with integral rivets 130 which enter holes 132 in lips 134 of the frame and are expanded to join the frame to the stud. Dials 116 protrude through slots 136 in the upper wall of the stud, which forms a rectangular face plate for the lock. Since shaft 120 is precisely located against the surfaces of recesses 126 of stud B, the desired amount of protrusion of the dials 116 through slots 136 is ensured. This arrangement is an improvement over prior combination locks in which the dial shaft is mounted on a back cover or frame. In the prior locks, the combination dials may not protrude sufficiently through slots in the front cover of the lock, or the dials may protrude so much that the associated sleeves bind on the front cover.

A compression spring 138 (FIG. 3) on shaft 120 urges the sleeves 118 into end-to-end abutting relationship with each other and urges each sleeve into engagement with its associated dial. The sleeve farthest from spring 138 abuts an enlargement 140 on shaft 120.

As shown in FIG. 7, each sleeve 118 has a flange 142 with a flat or bypass region 144. The orientation of flats 144 relative to a bolt 146 (FIGS. 3 and 4) determines whether the lock is locked or unlocked.

In the preferred embodiment, the bolt 146 resembles a fence, having a plurality of slots 148 defined between spaced bars 150. The combination dials 116 rotate freely in corresponding slots 148. The bolt is pivotally supported on the frame 128 of the lock by means of integral lugs 152 which project from opposite ends of the bolt at one side of the bolt. The lugs enter corresponding openings 154 in the ends of the frame. A compression spring 156 urges bolt 146 away from the bottom of the frame and into engagement with the flanges 142 of the sleeves 118. When the sleeves (and dials) are turned so that the flats 144 are all aligned to face the bolt 146, spring 156 causes the bolt to assume the position shown in FIG. 5 in dash-lines. When any sleeve has an orientation so that its flat does not face the bolt, its flange 142 engages the bolt and causes the bolt to assume the phantom-line position in FIG. 5. The dash-line position of bolt 146 is the "unlocked" position of the lock and the phantom-line position is the "locked" position of the lock. The effect of these positions on the latches A, A' will be apparent shortly, but first the remaining parts of the lock will be described.

A dial spring 158 (FIG. 4) has a base portion that fits in a longitudinal slot of frame 128 and has individual leaf spring arms 159 that engage the periphery of corresponding dials 116. Each dial has a series of recesses 160 (FIG. 7) which receive the ends of the dial spring arms for indexing of the dials. To permit changing of the combination of the lock, a sleeve-shifting lever 162 (FIG. 3) is mounted on shaft 120. The lever projects through a slot 164 in frame 128 and through a slot 166 in channel piece H. When the lever is moved to the left in FIG. 3, shaft 120 and sleeves 118 are shifted to the left, shifting each sleeve axially with respect to the corresponding dial 116. This disengages the teeth 122 of the sleeves from the teeth 124 of the dials, so that the dials may be turned relative to the sleeves to select a new combination. If lever 162 is then released and is returned to its original position by spring 138, the sleeves will move to the right and be recoupled to the dials. The lock will unlock only when the dials are set to the new combination. The combination can only be changed when the lock has first been set on combination and the case on which the lock is mounted has been opened to expose lever 162 at the inside of the case. Also, an abutment 167 on lever 162 engages bolt 146 when the lock is not in its unlocked position, preventing the lever from moving to uncouple sleeves 118 from dials 116. Openings a and b are provided to permit a probe to be inserted into recesses c in the sleeves to "find" the combination if it is forgotten.

Bolt 146 has a pair of lugs 168 (FIG. 4) which protrude through openings 170 in the bottom of frame 128 when the lock is locked (off combination). In this position, lugs 168 enter notches 171 (FIGS. 3 and 5) of the control rods I, I', blocking the movement of the control rods that is required to release the latches A and A'. When the lock is unlocked (on combination), lugs 168 are withdrawn from notches 171, permitting the movement of the control rods required to release the latches.

FIG. 8 illustrates the general plan of a luggage console L employing hardware in accordance with the embodiment just described. By virtue of the invention, a single combination lock C determines when a pair of spaced pivoting latches A, A' can be released by manual actuators J, J' adjacent to the latches. A virtue of the invention is that a manufacturer of hardware may supply the console L as a unit to a manufacturer of luggage. The latter may then assemble the console with the luggage shell, in a conventional manner, to form a suitcase as shown in FIG. 1, for example. The handle D may be attached to the console by the luggage manufacturer. To mount the handle the only operations required are assembling the wires 48 at the handle ends with the washers 50, loosening of screws 46 (FIG. 2) so that the handle studs B, B' may be moved away from valance member E sufficiently to permit lateral insertion of the tapered washers 50 into the grooves 52 (FIG. 3) of the handle studs, and re-tightening of the screws 46.

FIG. 9 illustrates a modified console L' employing luggage hardware in accordance with the invention, where the length of the luggage (and valance E') requires that the latches A, A' be spaced farther apart to ensure secure latching of the hinged parts of the luggage. Since the same spacing of the handle studs B, B' is desirable to accommodate a handle of standard length, increased spacing of latches A, A' is accomplished by the use of spacer plates K, K' between the latches and the associated handle studs. The latches may then be pivotally supported on the spacer plates, rather than on the handle studs.

As shown in FIG. 10, each spacer plate, K or K', may have mounting posts 172 for mounting the spacer plate on the channel piece H in the same manner as the handle studs B, B'. Each spacer plate may also have trunnions 54 and a supporting element 56 forming a T-bar like the corresponding T-bar of the handle studs. The underside of each spacer plate may have recesses and a central notch like the recesses 58 and notch 61 of the latch plates 60, for receiving trunnions 54 and support element 56 of the handle studs. The control rods I, I' employed in the embodiment of FIG. 9 will have to be made longer than those employed in the embodiment of FIG. 8, of course.

FIG. 11 illustrates a modified luggage console L" that is appropriate for a cosmetic case 174 or the like, in which a combination lock C and a single latch A are employed with a valance member E" and are disassociated from a carrying handle (not shown) and its mountings. The latch A may releasably retain a single hasp (not shown) mounted on the hinged lid of the case (above valance member E") The housing B" for the combination lock may be formed like the handle stud B, except that no upraised portion 24 is required. A single manual actuator J associated with latch A moves a control rod (not shown) which may be like the control rod I of FIG. 2.

It is apparent that the invention provides highly advantageous luggage consoles and luggage hardware systems as well as improved luggage hardware components. The versatility of the invention is apparent from a comparison of FIGS. 8, 9 and 11. Although the consoles differ, all three embodiments advantageously employ simple spring-biased pivoting latch mechanisms controlled by a single combination lock. The latch mounting plate may be a handle stud, a combination lock cover plate, or merely a simple plate. In each instance a simple reciprocative manual actuator releases a latch that then pops open automatically. Moreover, although the combination lock may be housed in a handle stud, the dials of the lock are readily accessible, rather than being covered by the handle, as in prior luggage hardware.

While preferred embodiments of the invention have been shown and described, it will be apparent to those skilled in the art that changes can be made in the preferred embodiments without departing from the principles and spirit of the invention, the scope of which is defined in the appended claims.

The invention claimed is:

1. Hardware for luggage cases and the like, comprising a valance member adapted to be attached to one part of a luggage case along an edge thereof, a latch, means supporting the latch on the valance member for pivotal movement about an axis perpendicular to the edge near one end of the latch, the latch being pivotally movable away from the valance member to an open position and toward the valance member to a closed position, spring means for biasing the latch toward its open position, control means supported for movement along the valance member, the control means and the latch having cooperating catch elements that are engageable to hold the latch in its closed position, spring means for biasing the control means in a first direction to engage the catch elements, and manual actuator means near the opposite end of the latch and coupled to the control means for moving the control means in a second direction to disengage the catch elements and release the latch for movement to its open position, the latch having a latch element thereon adapted to engage a cooperable latch element on a second part of the case that moves toward the valance member when the parts of the case are brought together.

2. Hardware in accordance with claim 1, further comprising lock means which, when locked, blocks the movement of the control means in the second direction that is required for releasing the latch and which, when unlocked, permits such movement.

3. Hardware in accordance with claim 2, wherein the latch supporting means also supports the lock means on the valance member.

4. Hardware in accordance with claim 3, wherein the latch supporting means comprises a housing and the lock means comprises a combination lock in the housing having bolt means for blocking and unblocking movement of the control means.

5. Hardware in accordance with claim 4, wherein the control means comprises a rod supported for reciprocation beneath the valance member, one end of the rod cooperating with the bolt means and the other end of the rod being fixed to the manual actuator means.

6. Hardware in accordance with claim 5, wherein the actuator means moves toward the latch supporting means to disengage the catch elements.

7. Hardware in accordance with claim 1, wherein the latch element of the latch comprises camming means for drawing the cooperable latch element toward it when the latch elements are engaged and the latch is moved toward its closed position.

8. Hardware for luggage cases and the like, comprising a base, a pair of handle studs, means for supporting the handle studs on the base with first ends of the handle studs spaced apart to receive a handle therebetween, a pair of latches, means for supporting first ends of the latches on the base adjacent to second ends of the handle studs, respectively, for pivotal movement of the latches toward the base to close the latches and away from the base to open the latches, a pair of control rods supported for reciprocation along the base, each control rod and an associated latch having cooperable catch elements engageable to hold the latch closed, spring means for biasing the control rods to engage the catch elements of the control rods and the associated latches, manual actuators located adjacent to second ends of the latches, respectively, and coupled to the control rods, respectively, for moving the control rods to disengage the catch elements of the control rods and the associated latches, spring means for biasing the latches away from the base, and lock means, which, when locked, blocks movement of the control rods required to disengage to catch elements of the control rods and the associated latches.

9. Hardware in accordance with claim 8, wherein the latches have latch elements thereon engageable with corresponding hasps.

10. Hardware in accordance with claim 8, wherein each actuator is movable toward the associated latch to disengage the catch elements of that latch and the associated control rod.

11. Hardware in accordance with claim 8, wherein the lock means is a combination lock housed in one of the handle studs and having combination dials protruding through openings in that stud.

12. Hardware in accordance with claim 11, wherein the latches are pivotally supported on the handle studs.

13. Hardware in accordance with claim 11, wherein the latch supporting means comprises spacer plates located between the latches and the handle studs, respectively.

14. A combination lock comprising a housing having a face plate with slots therein, the housing being part of a handle stud for luggage, a shaft having combination dials supported for rotation thereon, the plate having support surfaces at its interior side against which the ends of the shaft are supported, with the dials protruding through the slots, respectively, by an amount determined by the engagement of the ends of the shaft with the support surfaces.

15. A combination lock in accordance with claim 14, wherein the housing has a back cover that holds the ends of the shaft against the support surfaces.

16. A combination lock in accordance with claim 15, wherein each dial is supported on the shaft via a coaxial sleeve that normally rotates with the dial and wherein the lock also comprises a bolt that can only be moved from a locked position to an unlocked position when the sleeves have a predetermined orientation.

17. A combination lock in accordance with claim 16, wherein the housing has a latch pivotally supported thereon and controlled by the bolt.

18. A latch mechanism for luggage comprising a mounting plate adapted to be mounted on a base, a latch plate, the mounting plate having a T-bar projecting from one end thereof and providing trunnions received in recesses beneath one end of the latch plate for pivotally supporting the latch plate on the mounting plate for movement between open and closed positions, the latch plate having a catch element thereon adapted to engage a cooperable catch element when the latch plate is moved to its closed position, and an ejector spring mounted between said plates and urging the latch plate to its open position.

19. A latch mechanism in accordance with claim 18, wherein the ejector spring is a leaf spring having one end engaging the T-bar and another end engaging the latch plate.

20. A latch mechanism in accordance with claim 19, wherein the other end of the leaf spring is trapped beneath the latch plate by a member supporting the first-mentioned catch element.

21. A handle mounting assembly for luggage or the like comprising a base, a pair of handle studs, each having an open end with an internal groove, fastener means for attaching the handle studs to the base with the open ends in spaced opposition, and a handle dimensioned to fit between the studs and having washers at opposite ends adapted to enter the corresponding open ends of the studs and to be retained in the grooves, the shapes of the washers and the grooves being correlated so that the washers can enter the open ends laterally when the studs are separated from the base and be trapped in the grooves when the studs are thereafter tightly fastened to the base.

22. A handle mounting arrangement in accordance with claim 21, wherein the open end of each stud is tapered so that its opening is widest adjacent to the base, wherein the groove of each stud extends about the tapered opening thereof, and wherein each washer is tapered so that it is widest adjacent to the base.

* * * * *